US005423504A

United States Patent [19]

Shenkar

[11] Patent Number: 5,423,504

[45] Date of Patent: Jun. 13, 1995

[54] FLOWER BOX BRACKET ASSEMBLY

[76] Inventor: Emanuel Shenkar, 4333 Veterans Hwy., Holbrook, N.Y. 11741

[21] Appl. No.: 288,802

[22] Filed: Aug. 12, 1994

Related U.S. Application Data

[63] Continuation of Ser. No. 74,533, Jun. 11, 1993, abandoned, which is a continuation of Ser. No. 806,538, Dec. 13, 1991, Pat. No. Des. 338,637.

[51] Int. Cl.[6] ..... A47G 7/00

[52] U.S. Cl. ..... 248/201; 211/88; 248/250; 248/311.2

[58] Field of Search ..... 248/201, 27.8, 311.2, 248/250, 235; 211/88, 90, 183; 47/68, 41.01, 44, 40

[56] References Cited

U.S. PATENT DOCUMENTS

| | | | |
|---|---|---|---|
| 317,939 | 5/1885 | Halfpenny | 47/40 X |
| D. 338,637 | 8/1993 | Shenkar | D11/156 |
| 1,354,270 | 9/1920 | Wood | 248/250 |
| 2,477,771 | 8/1949 | Sanford | 248/250 X |
| 2,681,786 | 6/1954 | Sparring | 248/250 X |
| 3,017,155 | 1/1962 | Scarpetti | 248/250 X |
| 3,185,426 | 5/1965 | Bjerke | 248/250 |
| 3,800,470 | 4/1974 | Kleine | 47/40 X |
| 4,576,292 | 3/1986 | Percival | 211/88 X |
| 4,898,354 | 2/1990 | Whittington et al. | 248/201 X |

FOREIGN PATENT DOCUMENTS

| | | | |
|---|---|---|---|
| 271651 | 6/1988 | European Pat. Off. | 211/88 |
| 459845 | 12/1991 | European Pat. Off. | 47/40 |
| 1052719 | 12/1966 | United Kingdom | 248/250 |
| 1087445 | 10/1967 | United Kingdom | 47/68 |

*Primary Examiner*—Ramon O. Ramirez
*Assistant Examiner*—Derek J. Berger
*Attorney, Agent, or Firm*—Finnegan, Henderson, Farabow, Garrett & Dunner

[57] ABSTRACT

A bracket assembly for supporting an ornamental box having a bottom and peripherally contiguous side and end walls defining outer box surfaces having a preestablished design embossed thereon. A pair of brackets are included in the assembly for supporting opposite ends of the ornamental box. Each of the pair of brackets has a horizontal floor to underlie the bottom of the box adjacent the end walls thereof, and a vertically oriented, generally U-shaped containment wall having inner and outer bracket surfaces. The lower end portions of the outer box surfaces are recessed to receive the U-shaped containment walls in a manner so that the preestablished design on the box surfaces is extended to include the outer bracket surfaces, and so that the box is removably supported by the brackets against lateral displacement by the inner bracket surfaces.

5 Claims, 4 Drawing Sheets

FLOWER BOX BRACKET ASSEMBLY

CROSS REFERENCE TO RELATED APPLICATION

This application is a continuation of application Ser. No. 08/074,533, filed Jun. 11, 1993, now abandoned, which is a continuation of Ser. No. 07/806,538, filed Dec. 13, 1991, now U.S. Pat. No. Des. 338,637.

BACKGROUND OF THE INVENTION

The present invention relates to brackets for supporting ornamental boxes and, more particularly, it concerns an assembly of a flower box and supporting brackets.

In copending application Ser. No. 07/806,538, there is disclosed an ornamental design for a flower box in which a generally rectangular box is provided with side and end walls each having a relieved exterior design framed by top, bottom and end marginal surfaces. The flat surface at the bottom of the embossed portion extends continuously about the bottom periphery of the box to provide a part of the overall esthetic design to which the aforementioned application is directed.

To support the ornamental flower box securely and removably, either on a vertical wall under a window, for example, or on the top surface of a structure such as a deck railing, a pair of end brackets are employed. The end brackets function in some measure to support the weight of the box and, more significantly, to retain the box against movement in a horizontal plane. This latter function is served by a generally U-shaped vertical wall projecting from the support surface of each bracket so that opposite ends of the box are supported and confined. To preserve the ornamental design of flower box, the lower end portions of the box are recessed to receive the vertical wall portions of the brackets in a manner such that the outer surfaces of the vertical wall portions on each bracket lie flush with the lower marginal flat surface of the box and thus preserve the appearance of the box design without interference by the functional supporting brackets.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention comprises a bracket assembly for supporting an ornamental box having a bottom and peripherally contiguous side and end walls defining outer box surfaces having a preestablished design. A pair of brackets are included in the assembly for supporting opposite ends of the ornamental box. Each of the pair of brackets has a horizontal floor to underlie the bottom of the box adjacent the end walls thereof, and a vertically oriented, generally U-shaped containment wall having inner and outer bracket surfaces. The lower end portions of the outer box surfaces may be recessed to receive the U-shaped containment walls in a manner so that the preestablished design on the box surfaces is extended to include the outer bracket surfaces, and so that the box is removably supported by the brackets against lateral displacement by the inner bracket surfaces. Each of the brackets may include a depending vertical plate at one end of the floor for securement to a vertical wall, and an angular strut extending from the vertical plate at a location thereon spaced from the floor to the opposite end of the floor.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention. In the drawings.

Figure 1:
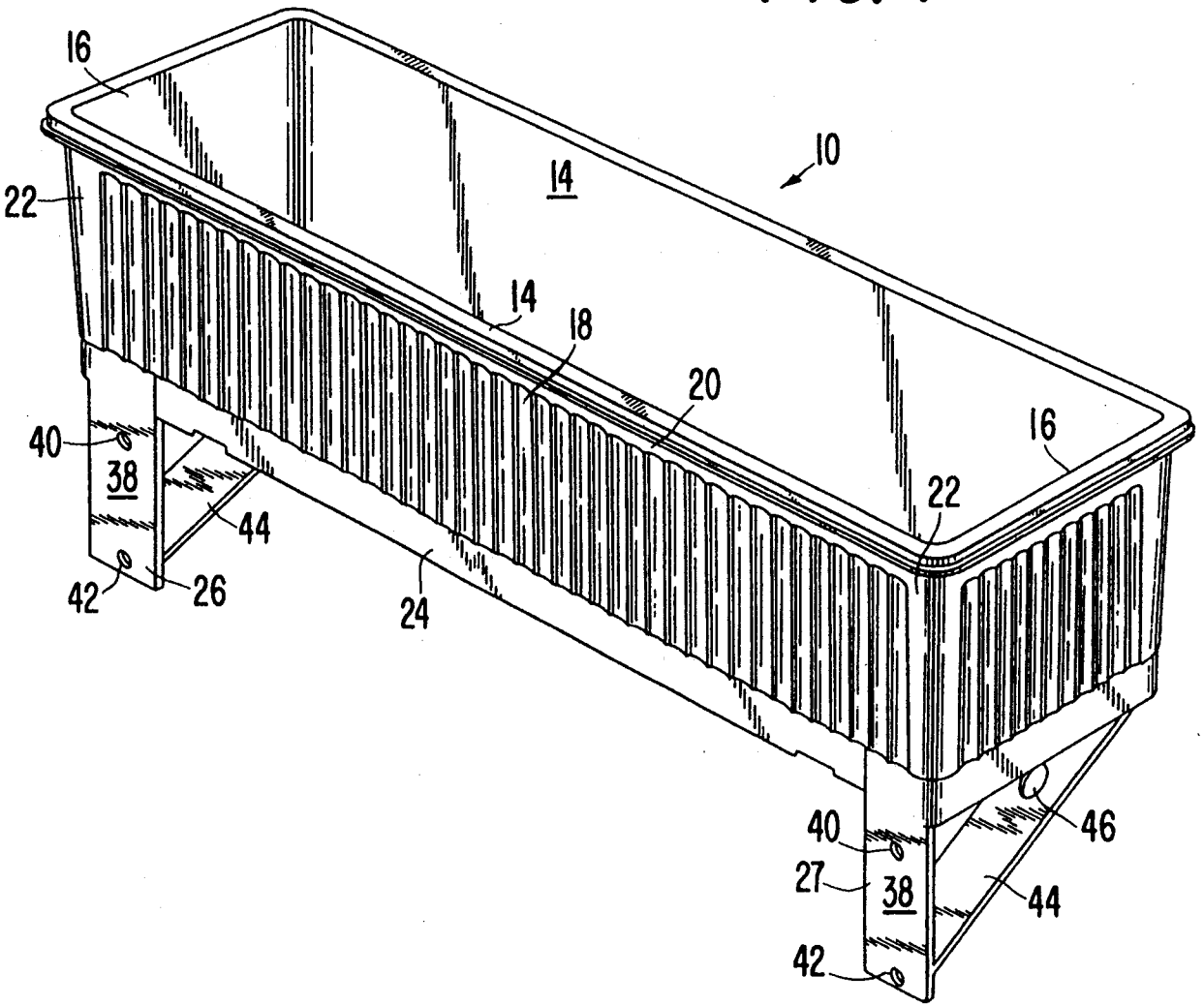
FIG. 1 is a perspective view showing an embodiment of the invention.

DESCRIPTION OF THE PREFERRED EMBODIMENTS;

Reference will now be made in detail to the present preferred embodiments of the invention, an examples of which are illustrated in the accompanying drawings. Wherever possible, the same reference numbers will be used throughout the drawings to refer to the same or like parts.

In accordance with the present invention, there is provided an assembly of an ornamental box and a pair of brackets for engaging and supporting opposite ends of the box. Outer surfaces of the box are provided with an ornamental design which, by virtue of the construction of the box and brackets, is carried into the outer visible surfaces of the brackets when the box is mounted on the brackets.

As embodied herein, and shown in FIGS. 1–4 of the drawings, the ornamental box is a flower box generally designated by the reference numeral 10 and includes; a bottom floor 12 (FIG. 4) circumscribed by upstanding side walls 14 and end walls 16. The exterior of the box 10 is provided with a preestablished ornamental design which in the box 10, in the form of a central fluted area 18 framed by top, side and bottom marginal areas 22 and 24, respectively. The marginal areas are smooth surfaced in the illustrated embodiment and extend about corners joining the side and end walls; 14 and 16. Also it may be seen that the fluted design is embossed in the outer surface of each of the side and end walls.

To support the box 10 on a vertical wall surface, such as for example, the exterior wall of a building under a window, a pair of brackets 26 and 27 are provided. The individual brackets 26 and 27 are mirror images of each other to complement opposite ends of the box 10. The construction of both brackets 26 and 27 may be understood from FIGS. 5–11 of the drawings in which the bracket 26 is illustrated in detail.

As shown, the bracket 26 includes a generally rectangular horizontal floor plate 28 having an unobstructed inboard side edge 30 and provided at opposite ends and on the outboard side edge thereof with an upstanding, generally U-shaped containment wall 32. The wall 32, in turn, includes upwardly diverging inner wall surfaces 34 and, in the illustrated embodiment, smoothly contoured exterior wall surfaces 36.

A vertical mounting plate 38 having apertures 40 and 42 depends from one end of the floor plate 28 as shown most clearly in FIGS. 5, 6, 8 and 9 of drawings. An angled strut 44 extends from near the bottom of the vertical mounting plate 38 at a location spaced from the floor plate 28, upwardly to the floor plate at the end thereof opposite from the plate 38. The strut 44 thus functions as a compressive member to carry a load supported by the floor plate 28 when the vertical plate 38 is secured such as by screws or bolts extending through the apertures 40 and 42. To facilitate the insertion of such screws or bolts, an ellipsoid aperture 46 is provided in the strut 44. The aperture 46 enables a screw driver, for example, to access a screw inserted in the aperture 40.

Figure 5:
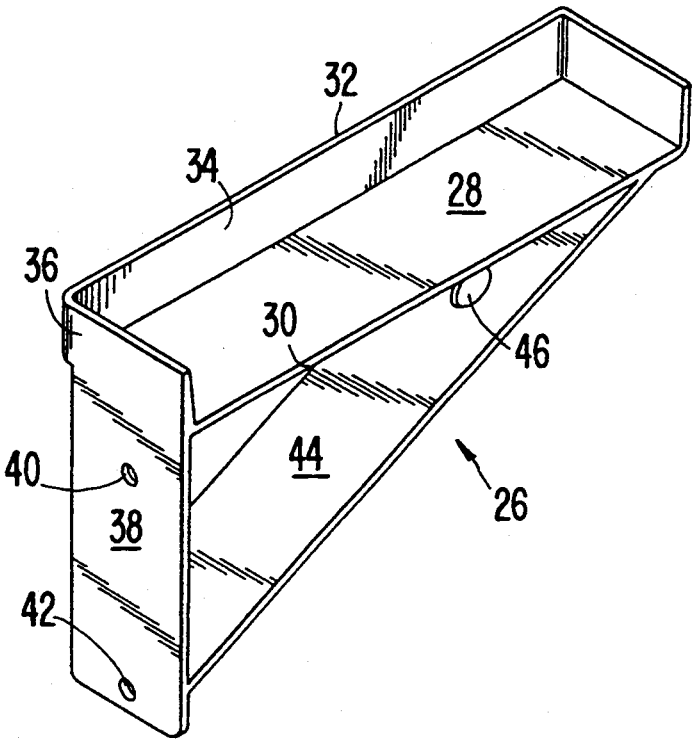
FIG. 5 is a perspective view showing an embodiment of a bracket used in the assembly of the invention.
Figure 6:
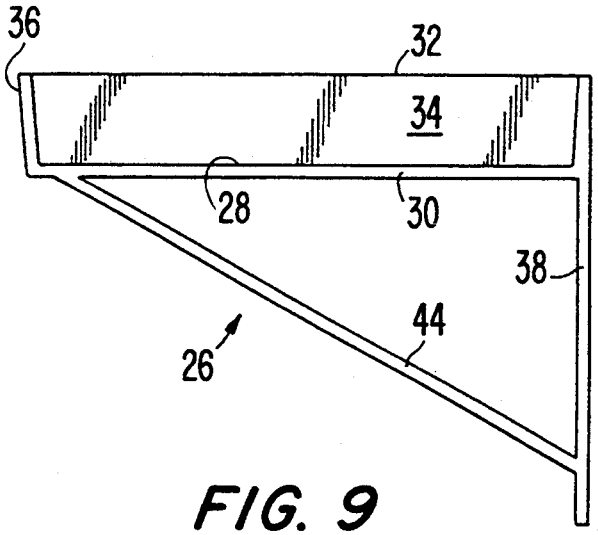
FIG. 6 is a side elevation showing one side of the bracket of FIG. 5.
Figure 7:
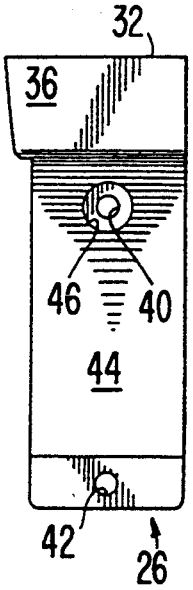
FIG. 7 is a front elevation of the bracket of FIG. 5.
Figure 8:
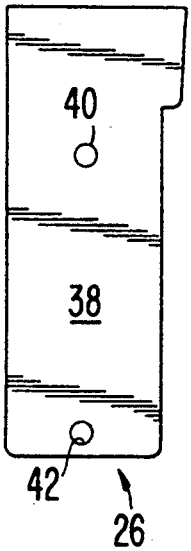
FIG. 8 is a rear elevation of the bracket of FIG. 5.
Figure 9:
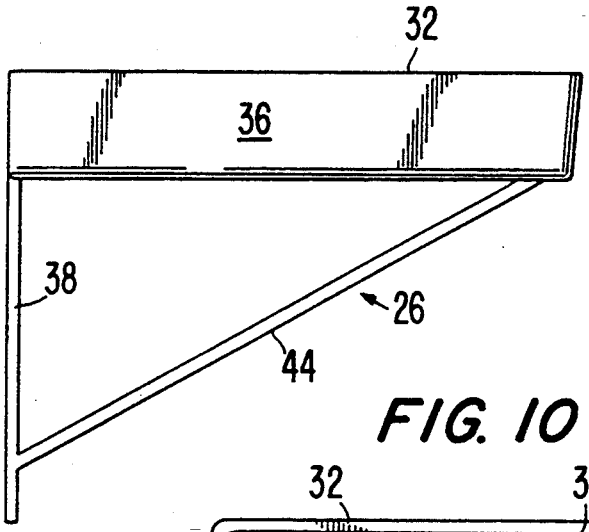
FIG. 9 is a side elevation showing a side of the bracket opposite from that shown in FIG. 6.
Figure 10:
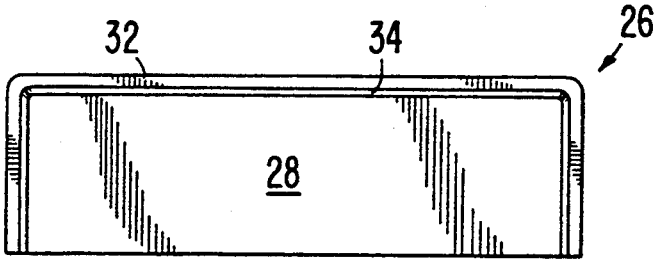
FIG. 10 is a top plan view of the bracket of FIG. 5.
Figure 11:
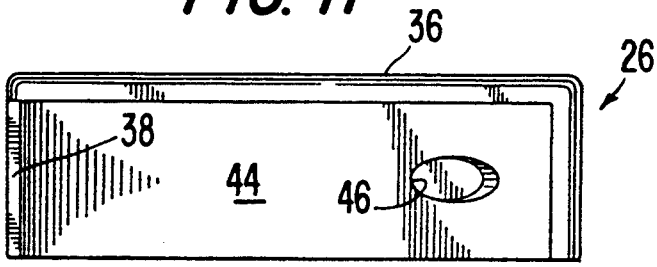
FIG. 11 is a bottom plan view of the bracket of FIG. 5.

As may be observed from FIGS. 5, 7 and 8 of drawings, the U-shaped wall 32 projects outwardly from the floor 28 along one side edge thereof. In the illustrated embodiment, the opposite sides of the vertical plate 38 and the end of the strut 44 lie in parallel planes, one of which planes also contains the inboard side edge 30 of the floor plate 28. The extent of projection of the U-shaped wall 32 from the opposite or outboard side of the vertical plate 38 and strut 44 from such a plane is apparent from the end views of FIGS. 7 and 8.

In accordance with the present invention, the lower end portions of the outer surfaces of the box are recessed to receive the U-shaped wall on each of the brackets so that the design on the exterior of the box is extended to include the outer bracket surfaces.

As here embodied, the box 10 includes outer surfaces that are recessed to receive the U-shaped wall 32 on each of the brackets 26 and 27 so that the design on the exterior of the box 10 is extended to include the outer bracket surfaces 36.

Figure 2:
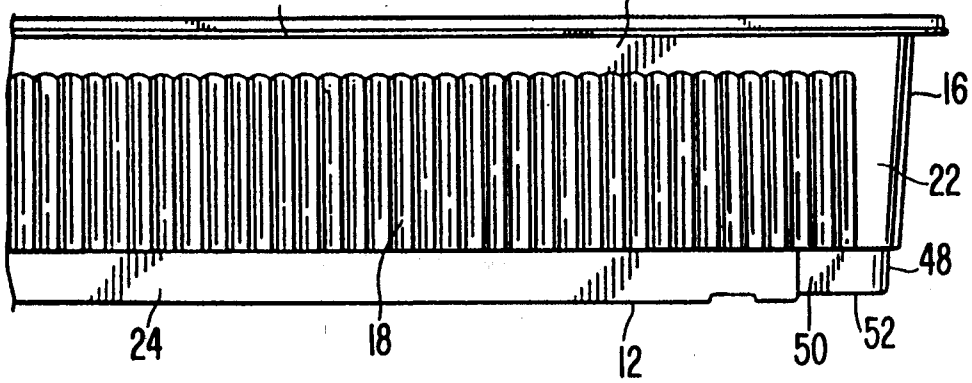
FIG. 2 is a fragmentary side elevation of the embodiment of FIG. 1 showing one end of an ornamental box to be supported by the bracket assembly of the invention.
Figure 4:
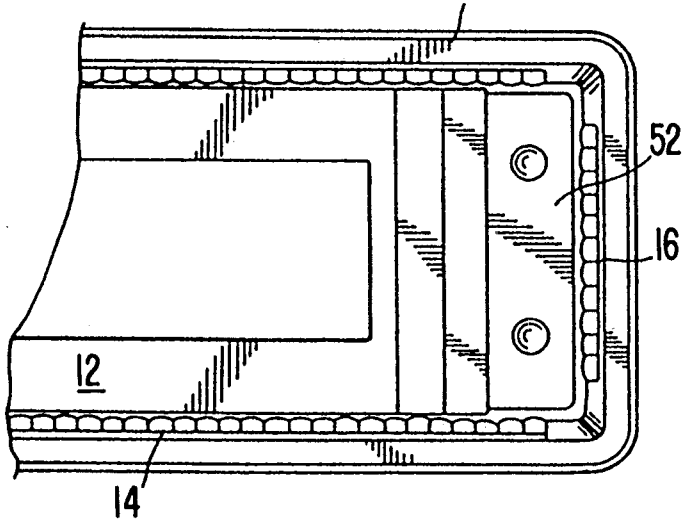
FIG. 4 is a fragmentary bottom plan view of the box shown in FIG. 2.
Figure 3:
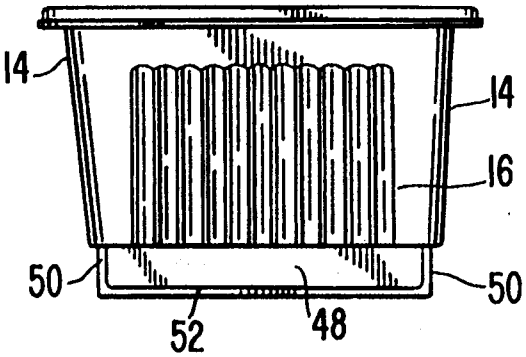
FIG. 3 is an end view of the box shown in FIG. 2.

In the illustrated embodiment, it will be noted from the illustrations in FIGS. 2, 3 and 4 that the end of the box adjacent the end wall 16, is recessed to a surface 48 spaced from the end wall 16, is recessed to surfaces 50 spaced from the exterior box side walls 14, and is recessed to a surface 52 spaced upwardly from the bottom surface of the bottom wall 12. As a result of the recessed configuration at both ends of the box 10 near the bottom thereof, the box 10 may be supported on the brackets 26 and 27 so that the exterior bracket surfaces 36 merge with the design on the exterior of the box 10. This feature of the invention may be seen in FIG. 1 of the drawings.

It is apparent from the illustrations in FIGS. 5–9 of the drawings that the components of each bracket 26 and 27 are integrated as a monolithic molding or casting. This construction is preferred particularly where the box 10 is molded or cast from such materials as plastic, metal, ceramics and the like. However, where the box 10 is fabricated from wood, for example, the exterior design of the box may be more compatible with wooden brackets formed of multiple components glued or otherwise fabricated.

Figure 12:
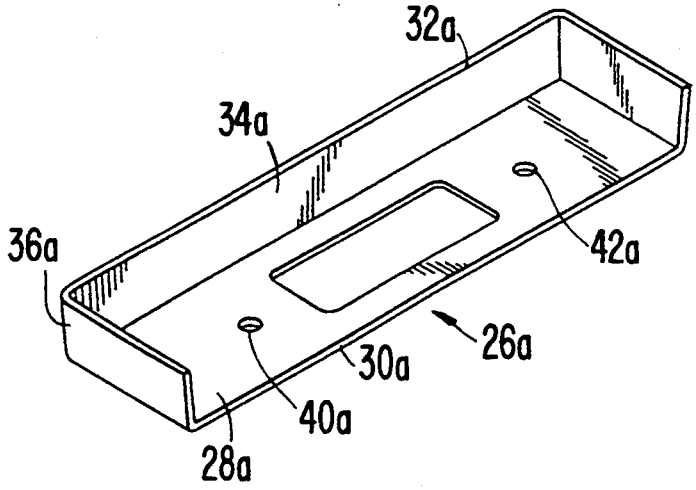
FIG. 12 is a perspective view showing an alternative embodiment of a bracket used in the assembly of the, invention.

In FIG. 12, an alternative bracket is shown in which parts corresponding to those of the brackets 26 and 27 are designated by the same reference numerals with an "a" suffix. The bracket **26*a* and a complementing mirror image bracket (not shown) function to retain the box 10 against lateral displacement while is supported on a floor, deck, deck railing or the like. As such the floor 28*a* is provided with fastening apertures 40*a* and 42*a* for securement by screws, bolts, or the like (not shown) directly to a horizontal surface. In all other respects, the visible parts of the bracket 26*a* merge with the design of the box 10 in the same manner as the brackets 26 and 27**.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A bracket assembly for supporting an ornamental box having a bottom and peripherally contiguous side and end walls defining outer box surfaces having a preestablished design thereon, the assembly comprising: a pair of brackets for supporting opposite ends of the ornamental box, each of said pair of brackets having a horizontal floor to underlie the bottom of the box adjacent the end walls thereof, and a vertically oriented, generally U-shaped containment wall having a continuous top edge of uniform height above said floor and inner and outer bracket surfaces, so that when said brackets are spaced by the length of the box with the inner bracket surfaces in mutually facing relationship, the box may be removably supported by said brackets against lateral displacement by said inner bracket surfaces, and so that said continuous top edge is adapted to complement the preestablished design of the outer box surfaces.

2. The bracket assembly recited in claim 1 wherein each of said pair of brackets includes a depending vertical plate at one end of the floor for securement to a vertical wall, and an angular strut extending from said vertical plate at a location thereon spaced from the floor to the opposite end of the floor.

3. An ornamental box and bracket assembly comprising:

an ornamental box having a bottom and peripherally contiguous side and end walls defining outer box surfaces having a preestablished design embossed thereon; and a pair of brackets for supporting opposite, ends of the ornamental box, each of said pair of brackets having a horizontal floor to underlie the bottom of the box adjacent the end walls thereof, and a vertically oriented, generally U-shaped containment wall having a continuous top edge of uniform height above said floor and inner and outer bracket surfaces, the lower end portions of the outer box surfaces being recessed to receive said U-shaped containment walls in a manner so that the preestablished design on the box surfaces is extended to include said outer bracket surfaces, and so that said box is removably supported by said brackets against lateral displacement by said inner bracket surfaces.

4. The assembly recited in claim 3 wherein each of said pair of brackets includes a depending vertical plate at one end of the floor for securement to a vertical wall, and an angular strut extending from said vertical plate at a location thereon spaced from the floor to the opposite end of the floor.

5. The assembly recited in claim 4 wherein said U-shaped containment wall projects outwardly of one side of said floor and vertical edges of said vertical plate and said strut and and projects outwardly from said opposite end of the floor.

* * * * *

UNITED STATES PATENT AND TRADEMARK OFFICE

CERTIFICATE OF CORRECTION

PATENT NO. : 5,423,504

DATED : June 13, 1995

INVENTOR(S) : Emanuel SHENKAR

It is certified that error appears in the above-indentified patent and that said Letters Patent is hereby corrected as shown below:

Claim 3, column 4, line 61, after "opposite" delete --,--.

Claim 5, column 6, line 7, delete "and" (second occurrence).

Signed and Sealed this

Twelfth Day of September, 1995

*Attest:*

*Attesting Officer*

Bruce Lehman

BRUCE LEHMAN

*Commissioner of Patents and Trademarks*